United States Patent [19]

Thoma

[11] 4,142,450

[45] Mar. 6, 1979

[54] AXIAL PISTON ROTARY HYDRAULIC MACHINES

[76] Inventor: Jean U. Thoma, Bellevueweg 23, 6300 Zug, Switzerland

[21] Appl. No.: 758,135

[22] Filed: Jan. 10, 1977

[30] Foreign Application Priority Data

Jan. 13, 1976 [CH] Switzerland ..... 542/76

[51] Int. Cl.[2] ..... F01B 13/06

[52] U.S. Cl. ..... 91/485

[58] Field of Search ..... 91/484, 485; 91/499

[56] References Cited

U.S. PATENT DOCUMENTS

| | | | |
|---|---|---|---|
| 2,234,110 | 5/1942 | Vickers | 91/485 |
| 2,284,109 | 5/1942 | Vickers | 91/485 |
| 3,059,432 | 10/1962 | Thoma | 91/485 |
| 3,079,870 | 3/1963 | Thoma | 91/485 |
| 3,188,972 | 6/1965 | Thoma | 91/485 |
| 3,255,673 | 6/1966 | Thoma | 91/485 |

FOREIGN PATENT DOCUMENTS

| | | | |
|---|---|---|---|
| 311041 | 11/1972 | U.S.S.R. | 91/485 |
| 1318894 | 5/1973 | United Kingdom | 91/485 |

*Primary Examiner*—William L. Freeh

*Attorney, Agent, or Firm*—Young & Thompson

[57] ABSTRACT

A rotary hydraulic pump or motor of the axial piston type, including a rotary cylinder block (17) formed with cylinders containing pistons (15). The block is formed with ports (25) which co-operate with ports (26, 27) in a distributor plate or valve plate (19). The cylinder block is free to move in an axial direction, but is prevented from tilting. The valve plate (19) is fixed in an axial direction, but is allowed to tilt by means of a spherical abutment (36). Adjustable sleeves (28) accommodate the movement of the valve plate and convey the fluid to and from the cylinders (16) in the block.

5 Claims, 4 Drawing Figures

AXIAL PISTON ROTARY HYDRAULIC MACHINES

Figure 1:
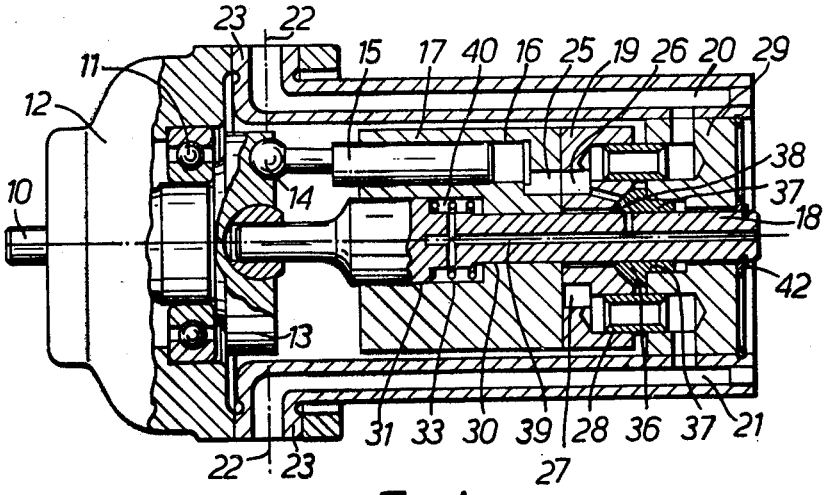

This invention relates to rotary hydraulic axial piston machines of the type having a rotary cylinder block with an end face provided with valve ports for the transfer of the working fluid to a non-rotating valve plate, or what is sometimes called a portplate. Such axial piston machines are known in two types, called "bent axis" and "swashplate" machines. The axial valve face of the cylinder block must be precisely parallel with the valve face of the valve plate, and at a precise distance therefrom, such that there will be formed an accurate controlled gap, usually having 5 – 20 μm gap height, in order to transport the working fluid correctly without too much leakage and without danger of seizing or damage to the rotating faces. The gap is usually obtained by providing for self-alignment, the parts being slightly adjustable and the different forces balanced in such a way that both valve faces align themselves in parallel at the desired distance or gap height.

In order to obtain self-alignment it is known to mount the cylinder block on a central shaft which can tilt slightly about both transverse axes, and is also free to move lengthwise. The piston forces and the pressure reaction forces acting on the valve faces are balanced in order to obtain the desired valve gap. This design is called a floating cylinder block but has the drawback of being very sensitive to disturbing forces on the cylinder block, such as piston friction or centrifugal forces acting on the pistons at high speed.

Another known solution is to provide a floating valve plate, which is mounted so as to be free to tilt slightly about both transverse axes and also free to move lengthwise. In such machines the working fluid is conveyed to and from the cylinder block through special connecting pipes or sleeves, which can adjust to allow the necessary movement of the valve plate. The balancing of the forces on the valve plate may be assisted by special supporting pistons between the valve plate and the stationary casing of the machine. In this type of machine the rotating cylinder block is mounted rigidly on the central shaft or spindle. In addition to the cost of the supporting pistons this floating valve plate design has the disadvantage that there are resultant axial forces acting on the central shaft and fluctuating rapidly at the piston frequency. They are equal to the difference between the piston forces and the pressure reaction forces of the fluid transfer sleeves and supporting pistons, and result in undesirable loads acting on the bearings of the central shaft.

An object of the present invention is to provide an axial piston machine with full self-alignment of the valve gap between the cylinder block and valve face, and also to avoid the drawbacks of the prior machines mentioned above. It is based on the geometric consideration, that for self-alignment 3° of freedom are needed, namely tilting about two orthogonal transverse axes, and lengthwise displacement. Each movement requires only a limited travel, just enough to take up the inevitable manufacturing and operational deviations.

The invention provides an axial piston rotary hydraulic machine, having a rotating cylinder block and a non-rotating valve plate arranged around a central shaft or spindle the cylinder block being mounted on the central shaft or spindle so as to allow lengthwise displacement and prevent tilting about transverse axes, and including locating means acting between the valve plate and a casing member which fixes the longitudinal position of the valve plate but permits at least limited tilting of the valve plate about two transverse axes, and tilting or movable adjustable fluid transfer ducts between the valve plate and the casing member, for conveying fluid to and from the cylinders in the cylinder block.

Thus in accordance with the invention the required degrees of freedom are divided such that the cylinder block is lengthwise displaceable but angularly fixed on the central shaft. The valve plate on the other hand is lengthwise fixed but free to move about both transverse axes at least to a limited extent. This design may be described as a semi-floating distributor. In practise the cylinder block is usually guided and located on the shaft, which can include a coupling such as splines for the transfer of torque. The valve plate engages the casing by means of an abutment member with a suitable guide surface, preferably a spherical surface. The guide surface can be arranged either between the valve plate and the abutment member, or between the abutment member and the casing. The abutment member preferably also includes a cylindrical part arranged to locate it centrally in the casing, on the central shaft, or in the valve plate.

The central shaft may comprise two portions with different diameters, which collaborate with accurate cylindrical bores in the cylinder block. High pressure working fluid can be ducted through suitable bores into the space between these shaft portions of different diameters, producting additional forces in the same way as a differential piston urging the cylinder block towards the valve plate. This allows the valve faces to be provided with larger openings.

Figure 2:
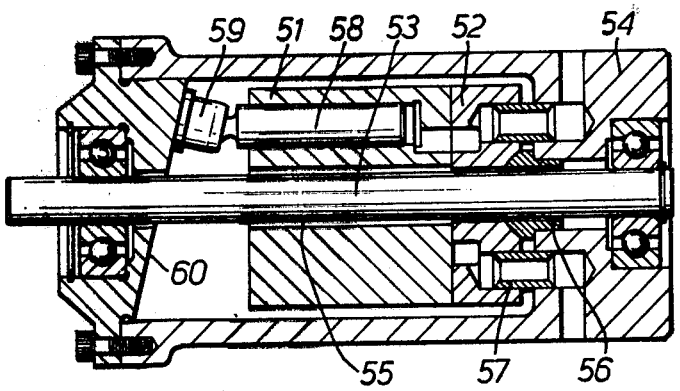
Figure 3:
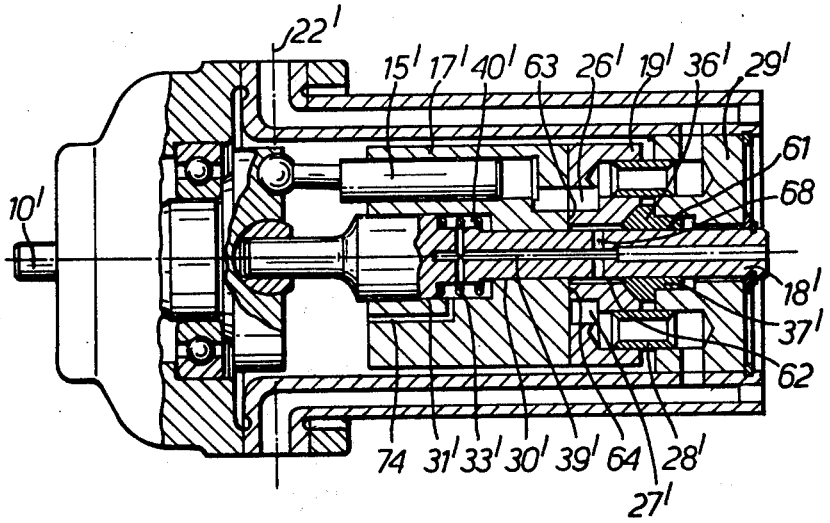
Figure 4:
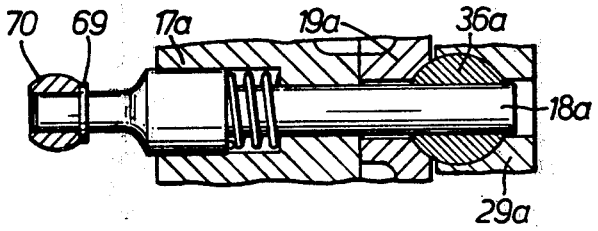

The invention may be performed in various ways and three specific embodiments will now be described by way of example, with reference to the accompanying drawings, in which FIGS. 1, 2, and 3, are each a sectional side elavation through a different form of hydraulic machine according to the invention, and FIG. 4 illustrates a modification of part of the machine of FIG. 3.

The machine illustrated in FIG. 1 is a "bent-axis" or so-called 'tilting head' machine, either a pump or motor, but for purposes of the present description it will be assumed to be a hydraulic pump. A rotary input drive shaft 10 at one end of the machine is mounted in a bearing 11 supported in a stationary casing 12, and the shaft is rigidly connected to a rotating head or disc 13 provided with an appropriate number of sockets to locate spherical ball-ends 14 provided on a number of pistons 15, mounted to reciprocate in cylinders 16 formed in a rotary cylinder block 17. The cylinder block rotates around a central spindle 18, as will be described below, and the spindle 18, together with the cylinder block 17, a cooperating valve plate 19, and a pair of hollow fluid input and output ducts 20, 21, can tilt or swing about a transverse axis 22 passing through hollow trunnions 23. As is well known, the purpose of this tilting movement is to vary the volumetric fluid capacity of the machine, or the quantity of liquid conveyed through the ducts 20, 21, for each revolution of the shaft 10 and cylinder block 17.

Each of the cylinders 16 communicates with a valve passage 25, and as the cylinder 17 rotates these passages communicate in succession with a fluid inlet kidney shaped port 26, and a fluid outlet kidney port 27, provided in the distributor or valve plate 19. These kidney ports in turn communicate via sleeves 28, with passage in an end plate 29, and with the ducts 20, 21. The cylinder block 17 is supported on the spindle 18 in such a way that it can shift a limited distance lengthwise, but is not free to tilt about any transverse axis. The spindle has a smaller diameter shaft portion 30, and an enlarged cylindrical head portion 31, and the cylinder block has internal bores of corresponding diameter to form a close sliding fit. A spring 33 acting between the head portion 31 of the spindle, and part of the block 17, urges the block towards the valve plate 19.

The valve plate 19 is mounted and located by an abutment member 36, having a part-spherical seating cooperating with a central part-spherical surface on the valve plate and also having a cylindrical stem 37 which fits in a central socket of the end plate 29. In this way the position of the plate 19 is fixed, both lengthwise and in transverse directions, but it is free to tilt a limited amount about two orthogonal transverse axes.

As shown in FIG. 1 the abutment member 36 is located through its cylindrical stem 37 in the casing end plate 29 and similarly the central spindle is located through a bore in the abutment member, whilst the central spindle has some play in the casing end plate 29. Alternatively, the central spindle 18 can be located in the casing cover or end plate 29, and therefore the abutment member 36 would be provided with radial play between its cylindrical stem and the central spindle, or the casing cover plate 29. In many cases it is of advantage to provide very little or no radial clearance between the central spindle, abutment member, and casing end plate. This results in a hyperstatic location and damps oscillations by the known "squeeze-film" effect.

The sleeves 28 in known manner transfer the working fluid from the casing cover or end plate 29 to the valve plate without preventing small tilting movements of the valve plate about the transverse axes. They must be slightly adjustable or movable, as can be obtained by suitable form and choice of material, for example they may have thin walls, short or spherical seats, or they may be formed of highly deformable material such as bronze or even synthetic plastics. Instead of cylindrical seats as shown, the sleeves may have axial face seats at one end.

High pressure oil is taken from the upper kidney port 26 in the valve plate through a duct 38 in the abutment member 36 and through a central duct 39 in the central spindle into the annular space 40 between the spindle portions 30, 31. Due to their different diameters the pressure forces act like a differential piston and urge the cylinder block towards the valve face. The corresponding reaction forces on the central spindle are transferred by a locating element, in the example of FIG. 1 a circlip 42 with a washer seating on the casing end plate 29. The central spindle can be either rotating or non-rotating, by use of suitable coupling pins. In the latter case the mating surfaces at 30 and 31 become rotary seals.

The annular space between the cylinder block 17, the valve plate 19, central spindle 18 and abutment member 36 is drained by a separate duct into the casing (not shown on FIGS. 1 and 2).

FIG. 2 illustrates another embodiment of the invention applied to a swashplate pump. Such machines are well known in principle and do not require detailed description. The abutment member 56 locates the valve plate 52 through its spherical surface and is located itself in the casing cover 54 by its cylindrical seat, whilst there is radial clearance between the abutment member and the central shaft. Fluid transfer sleeves 57 correspond to the sleeves 28 in FIG. 1.

There is a rotary cylinder block 51 with pistons 58 connected to slippers 59 sliding around a non-rotary inclined cam plate or swash plate 60. The block 51 is mounted by splines 55 on a central drive shaft 53 supported by bearings at both ends, and the block engages a valve plate 52, which is supported and located by a spherical seat on an abutment member 56 located in an end plate or cover 54, similar to the example of FIG. 1.

FIG. 3 illustrates another bent-axis or tilting head machine according to the invention. This is basically similar to that of FIG. 1 and corresponding parts are indicated by the same reference numerals, with an added suffix. In this example the annular space 40' within the cylinder block 17' is supplied with pressurised oil through the central duct 39', but the transverse duct 68 in the central spindle opens into an annular space 62 between the valve plate 19' and the central spindle, this space being confined lengthwise by the mating surfaces 30', and the mating surfaces 61 between the central spindle and the abutment member 36'. This annular space 62 has no unobstructed drain passage and consequently the leakage over the inner sealing lip at 63 from the upper kidney port 26' enters the annular space 62. Naturally if the lower kidney port 27' is at intake pressure, part of the working fluid will leak out over the lower sealing lip 64. Both leakage flows increase rapdily with gap height. In practice a certain pressure, about a quarter of delivery pressure, can be maintained in the annular space 62. The ducts 68 and 39' also convey this pressure to the annular space 40'. Both annular spaces are drained by leakage across the mating surfaces 31' and 18' whilst leakage over the spherical surface of the abutment member is usually negligible due to the high contact forces. These leakages are independent of valve gap height. Consequently the pressure in both annular spaces increases with valve gap height. This results in an additional force urging the cylinder block 17' towards the valve plate 19' and produces therefore an automatic stabilisation of control of valve gap height against disturbing forces, in a similar way to a hydrostatic bearing. Apart from design simplicity this outweighs in many cases the disadvantage that the urging forces are not as great as in FIG. 1 due to the reduced, (fractional) pressure in the annular space 40'.

The throttled drain flow or leakage across the mating surfaces can be assisted by a calibrated throttle or other drain port as shown at 74 in FIG. 3 as a long narrow duct in the cylinder block. Such a throttle groove can be made adjustable, by providing a screw needle valve and can be placed in the valve plate itself.

The mating surfaces at 30' in FIG. 3 are not here a seal, since there are equal pressures at both ends. The ducts 68 and 39' can therefore be replaced by open grooves in one of the mating parts at 30'. Such grooves do not disturb the rigid but lengthwise displacable mounting of the cylinder block on the central shaft according to the present invention.

One of the valuable technical advantages of axial piston machine according to this invention results from the relative insensitivity of the cylinder block to disturbing forces and from the small and continuous axial load on the central spindle or shaft.

FIG. 4 illustrates another bent axis or tilting head machine house construction, very similar to that of FIG. 3 and accordingly only the modified portions are illustrated in this figure. Parts which generally correspond to those of FIGS. 1 and 3 have been given the same reference numbers but with the suffix *a*.

As compared with the arrangement of FIG. 3, the abutment member 36*a* has now two spherical surfaces preferably around the same centre. They engage in spherical seats in the valve plate 19*a* and in the end plate or casing member 29*a* locating the valve plate longitudinally whilst allowing angular adjustment. The seat in the casing member 29*a* is preferably recessed as shown, consisting of a cylindrical portion followed by the spherical engaging surface itself. Thus the centre of the sphere 36*a* is located behind the end face of the casing member assuring a more secure transmission of the radial locating forces.

The abutment member 36*a* again has a bore which locates the central spindle 18*a* and can now adjust itself angularly with respect to the casing member 29*a* avoiding any edge pressure of the central spindle in its bore. Such edge pressure could be produced by manufacturing inaccuracies or deformation of the spindle under pressure forces.

In FIG. 4 the central spindle 18*a* is located lengthwise by a collar 69 which transmits spring and other forces to a spherical bearing 70 in the drive disc. Alternatively the central spindle 18*a* can be equipped with a collar near its other end engaging the flat portion of the spherical abutment member 36*a* around its axis.

I claim:

1. An axial piston rotary hydraulic machine including a casing, a central shaft, a rotating cylinder block having a plurality of generally parallel axial cylinders each containing a piston, said cylinder block surrounding and being axially slidably supported by said shaft, so as to allow limited lengthwise displacement of said block relative to said shaft but prevent tilting of said block about transverse axes, said central shaft being supported at both ends within said casing endwise beyond both ends of said cylinder block, a non-rotating valve plate surrounding said shaft and having ports to communicate successively with ports in an adjacent end face of said cylinder block on rotation of said block, and a single abutment member having a part-spherical abutment surface surrounding said shaft and in contact with a complementary surface on said valve plate, and centered on the axis of said shaft, said abutment member being grounded to a part of said casing and supporting said valve plate and allowing only pivotal movement of said valve plate about at least two axes transverse to the axis of the cylinder block by virtue of the part-spherical abutment surface of said single abutment member.

2. An axial piston machine according to claim 1, including a lengthwise displacable coupling for the transfer of torque between said cylinder block and said central shaft.

3. An axial piston machine according to claim 1, in which the abutment member has two part-spherical surfaces respectively engaging a corresponding part-spherical seat in the valve plate, and a corresponding part-spherical seat in the adjacent part of the casing.

4. An axial piston machine according to claim 1, in which the central shaft has two cylindrical surfaces of different diameters which co-operate with corresponding bores in said cylinder block to provide a pressure chamber, and the valve plate is arranged to form an annular space directly surrounding the shaft, whereby fluid under pressure leaking between said valve plate and said cylinder block flows into this annular space, and including a duct providing communication between the annular space and said pressure chamber, the annular space being of smaller cross-section than the pressure chamber, such that an additional force is created urging the cylinder block towards the valve plate.

5. An axial piston machine according to claim 4, including a drain passage for allowing fluid to escape at restricted rate from the said pressure chamber.

* * * * *